US011591910B2

(12) United States Patent
Breuer et al.

(10) Patent No.: US 11,591,910 B2
(45) Date of Patent: Feb. 28, 2023

(54) ROTARY AXIAL PISTON MACHINE WITH HYDROSTATIC PRESSING DEVICE SEAL ARRANGEMENT

(71) Applicant: Robert Bosch GmbH, Stuttgart (DE)

(72) Inventors: David Breuer, Tuebingen (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 146 days.

(21) Appl. No.: 17/158,679

(22) Filed: Jan. 26, 2021

(65) Prior Publication Data

US 2021/0254608 A1 Aug. 19, 2021

(30) Foreign Application Priority Data

Feb. 13, 2020 (DE) ..... 10 2020 201 803.0

(51) Int. Cl.

| | |
|---|---|
| ***F04B 1/2035*** | (2020.01) |
| ***F04B 1/2042*** | (2020.01) |
| ***F04B 1/2078*** | (2020.01) |
| ***F03C 1/06*** | (2006.01) |
| ***F04B 1/2007*** | (2020.01) |
| ***F04B 1/2021*** | (2020.01) |
| ***F01B 3/00*** | (2006.01) |

(52) U.S. Cl.

CPC ..... *F01B 3/0041* (2013.01); *F03C 1/0676* (2013.01); *F04B 1/2007* (2013.01); *F04B 1/2021* (2013.01); *F04B 1/2035* (2013.01); *F04B 1/2042* (2013.01); *F04B 1/2078* (2013.01)

(58) Field of Classification Search

CPC ..... F04B 1/20; F04B 1/2007; F04B 1/2021; F04B 1/2035; F04B 1/2042; F04B 1/2078; F04B 1/2085; F04B 1/0649; F03C 1/0676; F03C 1/0647; F03C 1/0649; F01B 3/0041; F01B 3/0044

See application file for complete search history.

(56) References Cited

FOREIGN PATENT DOCUMENTS

| | | | | |
|---|---|---|---|---|
| DE | 10 2012 110 485 A1 | | 5/2014 | |
| DE | 10 2018 205 446 A1 | | 10/2019 | |
| WO | WO-2016006465 A1 | * | 1/2016 | ..... F03C 1/0636 |

* cited by examiner

*Primary Examiner* — Kenneth J Hansen

(74) *Attorney, Agent, or Firm* — Maginot, Moore & Beck LLP

(57) ABSTRACT

A hydrostatic axial piston machine includes a pressing pressure chamber for the cylinder drum which is supplied with pressing pressure from a circular-arc-like elongate hole of a distributor plate or from a plurality of connection channels of the cylinder drum. The pressing pressure chamber is delimited radially outwardly by the cylinder drum and radially inwardly by the drive shaft. The pressing pressure chamber is delimited axially at both sides by seals which are both arranged between the radially inner rotating drive shaft and a radially outer stationary component. The radially outer component may be the cylinder drum or, in the case of the distributor-plate-side seal, also a gap seal between the drive shaft and a bearing bush of the distributor plate. Both seals are arranged at the distributor plate side with respect to a tooth arrangement or a retraction ball.

14 Claims, 5 Drawing Sheets

ROTARY AXIAL PISTON MACHINE WITH HYDROSTATIC PRESSING DEVICE SEAL ARRANGEMENT

This application claims priority under 35 U.S.C. § 119 to application no. DE 10 2020 201 803.0, filed on Feb. 13, 2020 in Germany, the disclosure of which is incorporated herein by reference in its entirety.

The disclosure relates to a hydrostatic axial piston machine of the swash plate construction type.

BACKGROUND

In axial piston machines, it is known that a cylinder drum is coupled to a drive shaft in a rotationally secure manner so that they rotate together. There extend along the drive shaft in the cylinder drum cylinders which are distributed over the periphery and in which pistons are displaceably guided. The pistons are coupled by means of respective piston bases and sliding blocks which rotate therewith to a stationary swash plate which is positioned obliquely with respect to the drive shaft. Therefore, each piston with every rotation about the drive shaft carries out a stroke, the size of which is dependent on the oblique position of the swash plate.

At the side opposite the swash plate, in an end face of the cylinder drum for each cylinder there is provided an opening which is connected by means of a respective connection channel to the respective cylinder. Since the end face of the cylinder drum rotates with the openings thereof, the openings run along a circular path. The end face is tensioned with the openings thereof against a stationary distributor plate so that the openings run in a sealed manner over circular-arc-shaped or kidney-like elongate holes of the distributor plate. More specifically, a high-pressure kidney-like member and a low-pressure kidney-like member are provided in the distributor plate.

As a result of the action of pressure medium of the high-pressure-side cylinder, the cylinder drum is tensioned at the high-pressure side thereof against the distributor plate. To this end, it is known from the prior art in order to increase the lift-off speed and with axial piston pumps in order to increase the self-priming speed to provide an additional pressing pressure chamber, which supplements and homogenizes the mentioned one-sided pressure.

In the publication DE 10 2012 110 485 A1, there is disclosed a pressing pressure chamber via which the cylinder drum is tensioned against the distributor plate. The pressing pressure chamber is concentric with respect to the drive shaft. In this instance, the pressing pressure chamber is delimited at the radially inner side by a sleeve which is arranged on the outer periphery of the drive shaft, whilst it is delimited at the radially outer side by a sleeve-like stepped pressure piston which is arranged on the inner periphery of the cylinder drum. When the pressing pressure chamber is acted on with high pressure, the pressure piston tensions the cylinder drum indirectly via a stop which is constructed as a securing ring against the distributor plate.

In the publication DE 10 2018 205 446 A1, a resilient chamber inside a retraction ball is used as a pressing pressure chamber. It is further proposed to extend this pressing pressure chamber in the direction toward the distributor plate by means of a pressure medium connection as a result of the tooth arrangement which is formed between the drive shaft and cylinder drum in the direction toward the distributor plate. Consequently, the pressing pressure chamber extends completely through the cylinder drum and also through the distributor plate as far as a bearing bush which is constructed as a gap seal. Via this bearing bush, the drive shaft is also supported in a connection plate. An annular end face which is arranged in the retraction ball and a radial step on the inner periphery of the cylinder drum act as pressure faces on the cylinder drum in the direction toward the distributor plate. Consequently, the pressing pressure chamber is delimited by the drive shaft, the cylinder drum and the retraction ball. Accordingly, a swash-plate-side and a distributor-plate-side seal and in addition a seal between the retraction ball and the cylinder drum are provided between the cylinder drum and drive shaft.

The disadvantage of the last-mentioned axial piston machines is that the pressing pressure chamber is delimited by three seals, which means a high level of technical device and technical assembly complexity.

SUMMARY

Accordingly, an object of the disclosure is to provide an axial piston machine whose pressing pressure chamber is simpler in technical device and technical assembly terms.

This object is achieved with an axial piston machine having the features described below.

The disclosed hydrostatic axial piston machine has a plurality of pistons, which are guided in a cylinder drum and which are coupled to a swash plate. The cylinder drum is coupled to a drive shaft in a rotationally secure manner and tensioned by means of a hydrostatic pressing device against a stationary distributor plate which is fixed to a housing. The pressing device has a pressing pressure chamber which is delimited by the drive shaft and the cylinder drum and which is further delimited by a swash-plate-side seal and a distributor-plate-side seal. The two seals are directly in abutment with the drive shaft at the respective inner sides thereof. According to the disclosure, at least the swash-plate-side seal is arranged directly between the drive shaft and the cylinder drum. In this instance, no third seal is provided. Consequently, the pressing pressure chamber is simplified in technical device and technical assembly terms.

If a retraction ball is arranged between the drive shaft and the swash plate, both seals and consequently the entire pressing pressure chamber are arranged at a distributor plate side of the retraction ball.

If a tooth arrangement is formed between the drive shaft and the cylinder drum for rotationally secure coupling, both seals are then arranged at a distributor plate side of the tooth arrangement.

It is particularly preferable for both seals to have a sealing diameter which is smaller than a root diameter of the tooth arrangement. Consequently, neither of the two seals has to be pushed over the tooth arrangement during assembly of the axial piston machine. Damage is thus prevented.

If a shaft shoulder is provided on the drive shaft between the two seals and in this instance the sealing diameter of the distributor-plate-side seal is smaller than the sealing diameter of the swash-plate-side seal, then a differential surface is provided and defines a pressing pressure chamber which is arranged inside the cylinder drum.

In a shorter version of the pressing pressure chamber, the distributor-plate-side seal may be arranged directly between the drive shaft and the cylinder drum or, in a longer version of the pressing pressure chamber, between the drive shaft and the distributor plate.

Preferably, the distributor-plate-side seal is a sealing ring, for example, an O-ring.

If the distributor-plate-side seal is a gap seal on a bearing bush, it is particularly preferable for the drive shaft to form a through-drive at both sides. To this end, the drive shaft also extends at the distributor plate side through a housing of the axial piston machine, for example, through the connection plate thereof.

If no pressure side change is required, according to a first embodiment a pressure medium connection can be formed between a circular-arc-like or kidney-like elongate hole of the distributor plate, which hole is acted on with high pressure, and the pressing pressure chamber which has a stationary radial groove of the distributor plate and a stationary annular groove of the distributor plate and at least one axial channel of the cylinder drum which is directly connected to the annular groove. The at least one axial channel rotates with the cylinder drum. If the annular groove is closed in a circular manner, an axial channel reaches in the cylinder drum. If the annular groove is not closed in a circular manner, that is to say, is only in the form of a circular arc, a plurality of axial channels are required in the cylinder drum.

If no pressure side change is required, the pressure medium connection can according to a second embodiment have, between the elongate hole which is acted on with high pressure and the pressing pressure chamber, the stationary radial groove of the distributor plate and an intermediate space which is formed between the distributor plate and the drive shaft and at least one axial channel of the cylinder drum which is directly connected to the intermediate space. The axial channel rotates with the cylinder drum. Since the intermediate space is closed in a manner extending around the drive shafts or is cylindrical, an axial channel reaches in the cylinder drum in order to always remain in pressure medium contact with the intermediate space.

In a housing, in particular in the connection plate thereof, two main channels may be provided.

If a pressure side change is required, the pressure medium connection may according to a third embodiment have, between (at one side) the two main channels and (at the other side) the pressing pressure chamber, a shuttle valve which is connected at the input side to the two main channels and at the output side to a stationary annular groove of the distributor plate. The annular groove is directly connected to at least one peripheral axial channel of the cylinder drum. If the annular groove is closed in a cylindrical manner, an axial channel reaches in the cylinder drum. If the annular groove is not closed in a circular manner, that is to say, is only in the form of a circular arc, a plurality of axial channels are required in the cylinder drum.

A connection channel may be provided in the cylinder drum between each cylinder and a respective opening which is arranged at an end face of the cylinder drum.

If a pressure side change is required, the pressure medium connection may have, between (at one side) a plurality or all of the cylinders or connection channels and (at the other side) the pressing pressure chamber, a non-return valve arrangement which is arranged in the cylinder drum. In the case, for example, of nine cylinders, at least three connection channels are connected to the pressing pressure chamber via the non-return valve arrangement.

According to a fourth embodiment, the non-return valve arrangement has a plurality of non-return valves which each connect a cylinder or connection channel to the pressing pressure chamber. Preferably, the non-return valves are distributed in a uniform manner between the connection channels. In the case, for example, of nine cylinders, at least three connection channels are connected to the pressing pressure chamber via a respective non-return valve arrangement. Or all the connection channels are connected to the pressing pressure chamber via a respective non-return valve.

According to a fifth embodiment, each connection channel is connected via a connection branch channel and a branch channel opening to the pressing pressure chamber, wherein the non-return valve arrangement has a resilient ring which is arranged on the outer periphery of the pressing pressure chamber and which abuts the branch channel openings so as to be able to be raised.

The pressing pressure in the pressing pressure chamber has to be dissipated via very small leakage locations in order to be able to adapt to a decreasing high pressure. To this end, defined leakage locations may be formed on the resilient ring.

BRIEF DESCRIPTION OF THE DRAWINGS

A plurality of embodiments of an axial piston machine according to the disclosure are illustrated in the Figures, in which.

DETAILED DESCRIPTION

Figure 1:
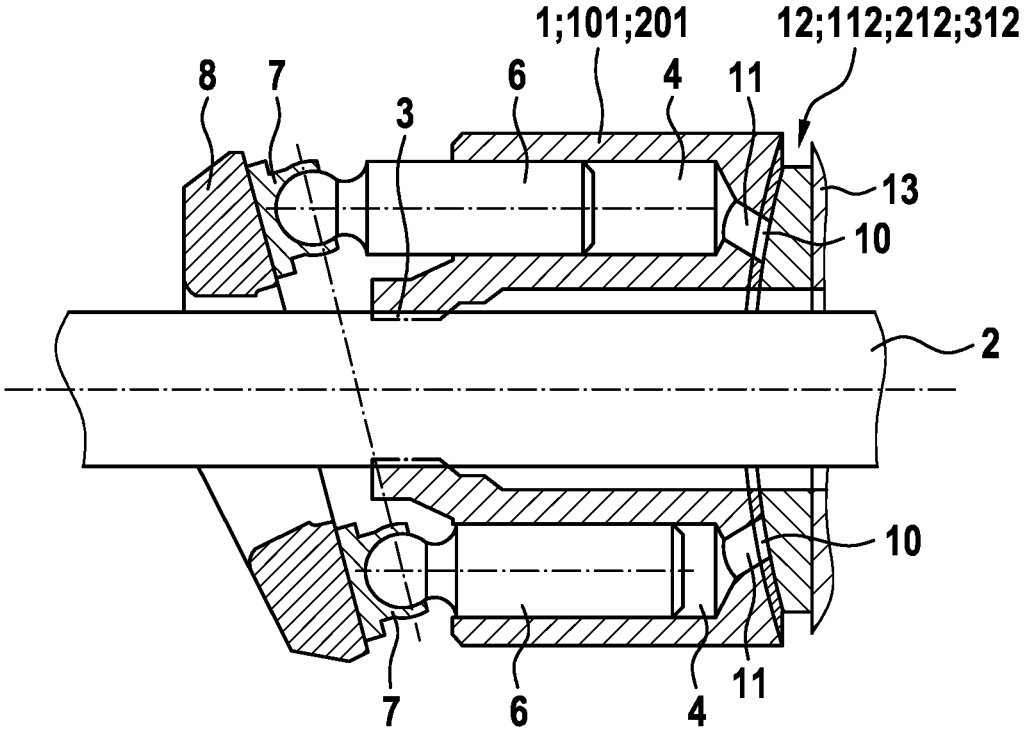
Fig. 1 (Prior Art)
FIG. 1 is a schematic longitudinal section of an axial piston machine according to the prior art, on which the pressing pressure chambers of the following embodiments can be provided.

FIG. 1 is a schematic, sectioned view of significant components of an axial piston machine of the swash plate construction type. A cylinder drum 1; 101; 201 is coupled to a drive shaft 2 in a rotationally secure manner by means of a tooth arrangement 3 so that they rotate together. Along the drive shaft 2, there extend in the cylinder drum 1; 101; 201 cylinders 4 which are distributed in a uniform manner over the periphery and in which pistons 6 are displaceably guided. Piston bases of the pistons 6 are coupled by means of sliding blocks 7 which rotate therewith in each case to a stationary swash plate 8 which is positioned in an oblique manner with respect to the drive shaft 2. Therefore, with each rotation about the drive shaft 2, each piston 6 carries out a stroke, the size of which is dependent on the oblique position of the swash plate 8.

At the end face of the cylinder drum 1; 101; 201 opposite the swash plate 8 for each cylinder 4 there is provided an opening 10 which is connected to the respective cylinder 4 by means of a respective connection channel 11. The end face rotates and is tensioned with the peripheral openings 10 thereof against a stationary distributor plate 12; 112; 212;

312 which is secured to a connection plate 13 (merely indicated) of a housing (not illustrated in greater detail) of the axial piston machine.

The embodiments described below may be provided in the axial piston machine shown in FIG. 1 but cannot be seen in the illustration according to FIG. 1.

Figure 2:
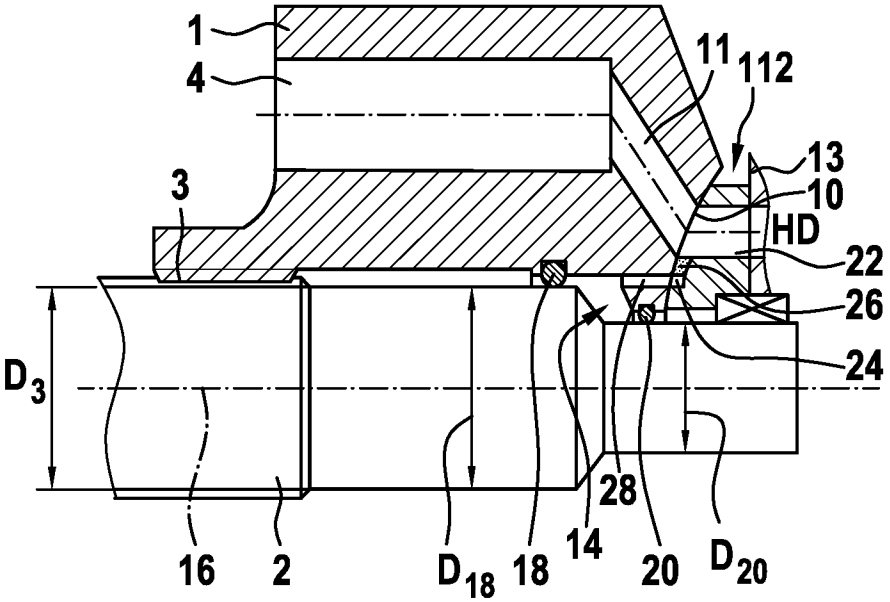
FIG. 2 is a longitudinal section of a portion of the axial piston machine according to the disclosure according to a first embodiment.

FIG. 2 is a longitudinal section of a portion of the axial piston machine according to the disclosure according to a first embodiment. The distributor-plate-side region of the drive shaft 2 and a side of the cylinder drum 1 are illustrated. The cylinder drum 1 is (in FIG. 2 on the right) pressed against the distributor plate 112 by the high pressure in the cylinders 4. In order to homogenize and increase this pressing force acting at one side, there is provided a pressing pressure chamber 14 which is delimited radially inwardly by the drive shaft 2 and radially outwardly by the cylinder drum 1. When viewed axially along a rotation axis 16 of the drive shaft 2 and the cylinder drum 1, the pressing pressure chamber 14 is delimited at one side by a seal 18 at the tooth arrangement side or swash plate side and, at the other side, by a distributor-plate-side seal 20 (the swash plate is arranged on the left in FIG. 2 and only illustrated in FIG. 1).

From the swash plate in the direction toward the distributor plate 112 (in FIG. 2 from left to right) there are provided along the rotation axis 16 first the tooth arrangement 3 having a root diameter $D_3$, then a diameter decrease of the drive shaft 2 to a sealing diameter $D_{18}$, on the outer periphery of which the swash-plate-side seal 18 which is constructed as an O-ring is arranged, then another diameter reduction of the drive shaft 2 to a sealing diameter $D_{20}$, on the outer periphery of which the distributor-plate-side seal 20 is arranged. The diameter difference $D_{18}$-$D_{20}$ of the two seals 18, 20 defines a differential surface-area which inside the cylinder drum 1 acts thereon as a pressing force in the direction toward the distributor plate 112 (in FIG. 2, from left to right).

According to the disclosure, both seals 18, 20 are pushed onto the illustrated end of the drive shaft during the assembly of the sub-assembly shown together with the cylinder drum 1 (in FIG. 2, from right to left). In this instance, there is also no contact of the swash-plate-side seal 18 with the tooth arrangement 3. Since no additional component, such as, for example, a retraction ball, is also affected by the pressing pressure chamber 14, no additional seals are also necessary.

Figure 3:
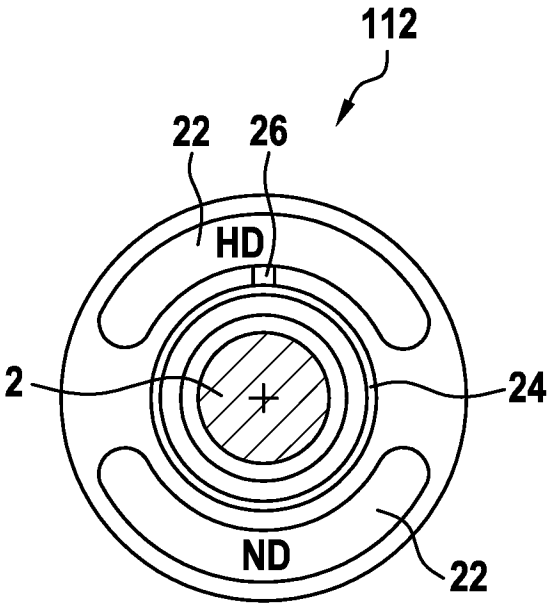
FIG. 3 is a view of a distributor plate from FIG. 2.

FIG. 3 is a view (according to FIG. 2 from left to right) of the distributor plate 112 of the first embodiment from FIG. 2. Since, in the axial piston machine shown, no pressure side change is required, one of two circular-arc-like elongate holes 22 is always acted on with high pressure HD. Radially inside the two elongate holes 22, an annular groove 24 extending in a circular manner is introduced into the illustrated surface of the distributor plate 112 facing the cylinder drum 1. Furthermore, between the elongate hole 22 which is acted on with high pressure HD and the annular groove 24, a radial grove 26 is introduced into the illustrated surface of the distributor plate 112 facing the cylinder drum 1.

FIG. 2 shows that the annular groove 24 of the distributor plate 112 is connected to an axial channel 28 of the cylinder drum 1. The axial channel 28 rotates together with the cylinder drum 1 about the rotation axis 16 and is consequently moved on a circular path along the annular groove 24. The axial channel 28 finally opens in the pressing pressure chamber 14. Consequently, a constant pressure medium connection of the elongate hole 22 which is acted on with high pressure HD to the pressing pressure chamber 14 is produced.

Figure 5:
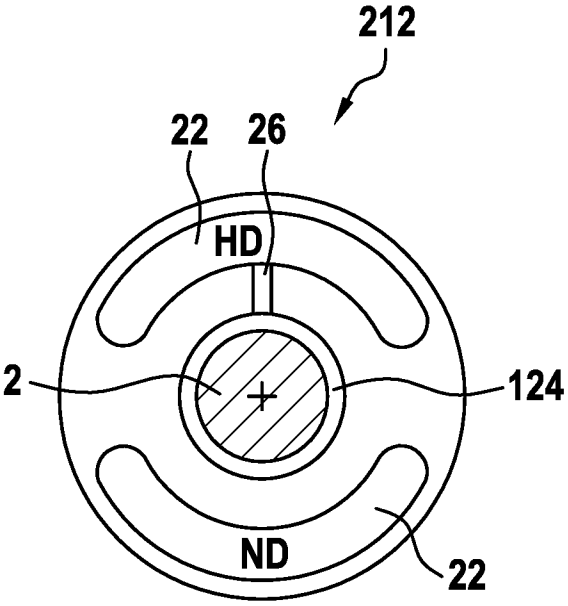
FIG. 5 is a view of a distributor plate from FIG. 4.
Figure 4:
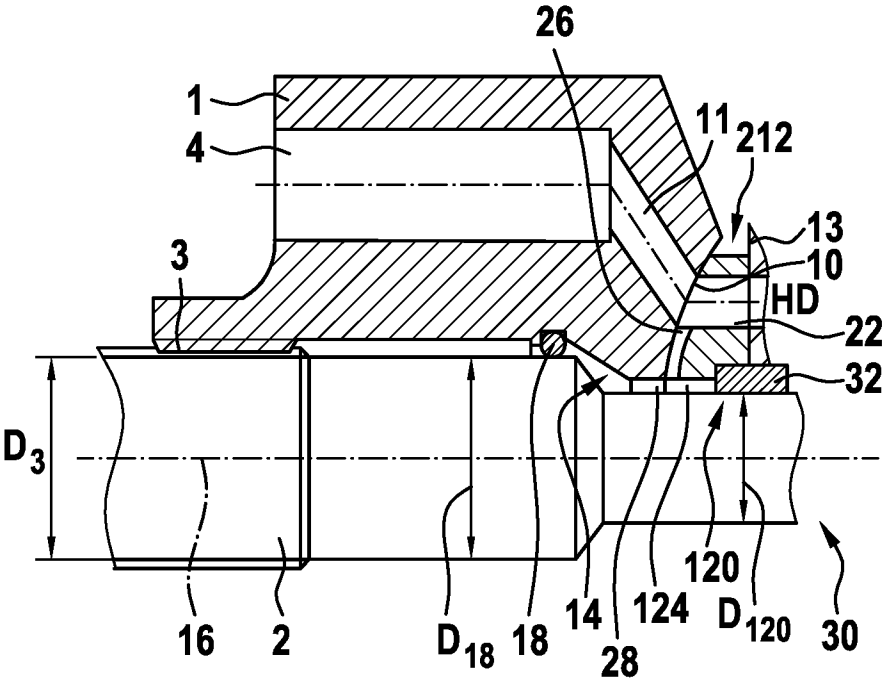
FIG. 4 is a longitudinal section of a portion of the axial piston machine according to the disclosure according to a second embodiment.

FIGS. 4 and 5 show a second embodiment which is similar to the first embodiment according to FIGS. 2 and 3. Only the differences of the second embodiment with regard to the first embodiment are described below.

Since the drive shaft 2 forms a through-drive 30 not only at the swash plate side, but also at the distributor plate side, the distributor-plate-side seal 120 is formed by a gap seal which is formed between a bearing bush 32 and the drive shaft 2, wherein the bearing bush 32 is inserted into the distributor plate 212 and into the connection plate 13.

FIG. 5 shows that the radial groove 26 of the distributor plate 212 opens (instead of in an annular groove 24) in an intermediate space 124 which is formed between the drive shaft 2 and the distributor plate 212.

FIG. 4 shows that this intermediate space 124 which extends in a circular manner over the entire periphery is delimited at one side (in FIG. 4, on the right) by the bearing bush 32, on the other side, the intermediate space 124 (in the same manner as the first embodiment according to FIGS. 2 and 3) is connected to the pressing pressure chamber 14 by means of an axial channel 28 which is formed in the cylinder drum 1.

Finally, in the second embodiment according to FIGS. 4 and 5, another difference is that the axial channel 28 is not completely constructed in the cylinder drum, in a manner delimited radially inwardly by the drive shaft 2.

The following three embodiments according to FIGS. 6 to 9 show possible ways of also always supplying the pressing pressure chamber 14 which is constructed according to the disclosure with high pressure HD when a pressure side change is possible with the axial piston machine.

Figure 7:
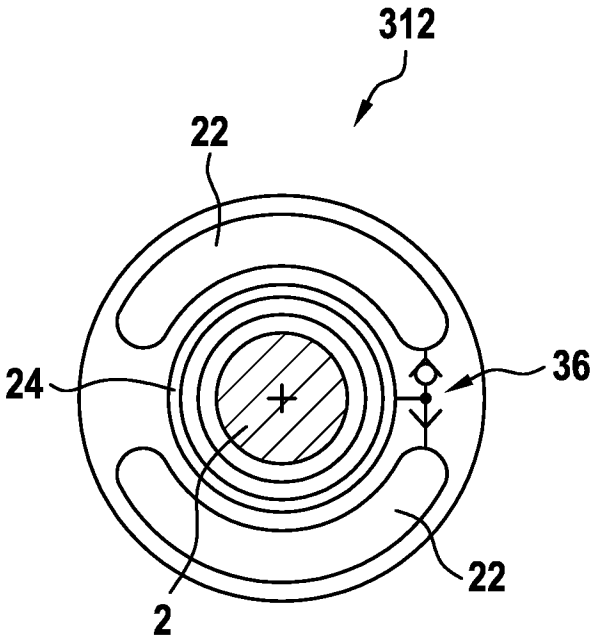
FIG. 7 is a schematic view of a distributor plate and a connection plate from FIG. 6.
Figure 6:
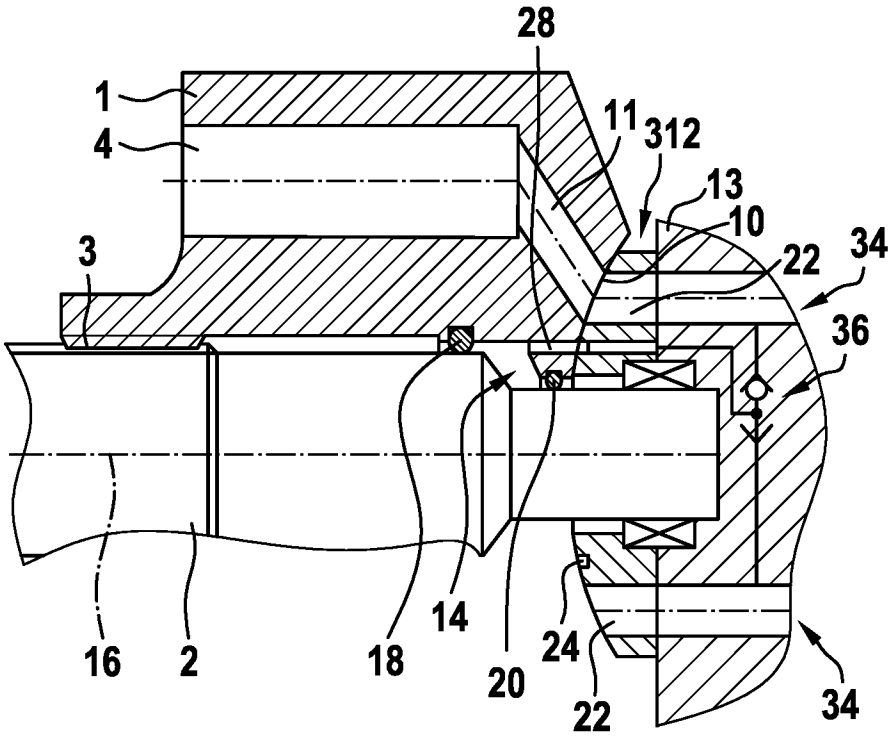
FIG. 6 is a longitudinal section of a portion of the axial piston machine according to the disclosure according to a third embodiment.

FIGS. 6 and 7 show a third embodiment, in which the pressure side change mentioned is possible. The cylinder drum 1 and the drive shaft 2 with the pressing pressure chamber 14 formed therebetween and the two seals 18, 20 correspond to those of the first embodiment according to FIGS. 2 and 3.

In contrast to the first embodiment, the constant pressure medium connection to supply the pressing pressure chamber 14 with high pressure HD has two main channels 34 which extend through the connection plate 13 and which are connected to the pressing pressure chamber 14 via a shuttle valve 36 which is also integrated in the connection plate 13. More specifically, an output of the shuttle valve 36 is connected via a channel portion formed in the connection plate 13 and via a channel portion formed on the distributor plate 312 to an annular groove 24 according to the first embodiment (from FIGS. 2 and 3).

FIG. 7 is a schematic illustration of a view of the distributor plate 312 with the elongate holes 22 thereof and the annular groove 24 together with the shuttle valve 36 which is arranged in the connection plate 13.

Figure 8:
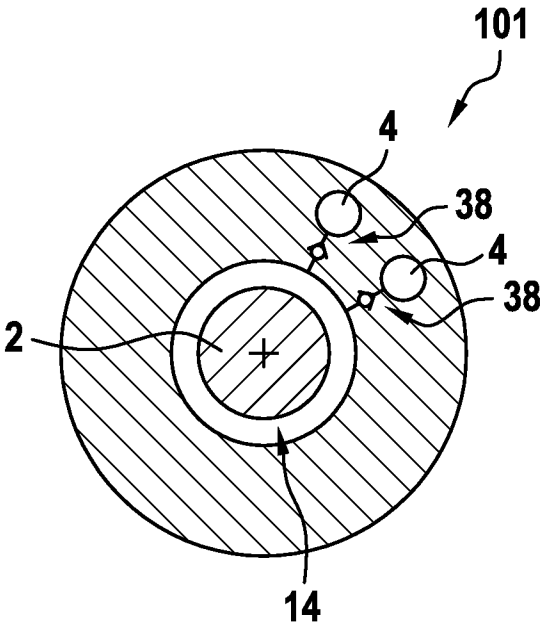
FIG. 8 is a view of a cylinder drum according to a fourth embodiment.

FIG. 8 shows only the cylinder drum 101 with the drive shaft 2 of a fourth embodiment of the axial piston machine according to the disclosure as a sectioned illustration, wherein the axial piston machine is also configured for a pressure side change.

Of the cylinders 4 which are distributed in a uniform manner over the periphery of the cylinder drum 101, only two are illustrated. It can be seen that the cylinders 4 are connected via a respective non-return valve 38 to the pressing pressure chamber 14 which is formed between the cylinder drum 101 and the drive shaft 2. In this instance, the non-return valves 38 may also be connected to the connection channels 11 (cf. FIG. 1).

In this instance, it is sufficient for only a part-quantity of all the cylinders 4 which are distributed in a uniform manner over the periphery to be connected to the pressing pressure chamber 14 via such a non-return valve 38 in order to ensure that one of the cylinders 4 which are acted on with high pressure HD is always connected to the pressing pressure chamber 14 via the non-return valve 38 thereof.

Figure 9:
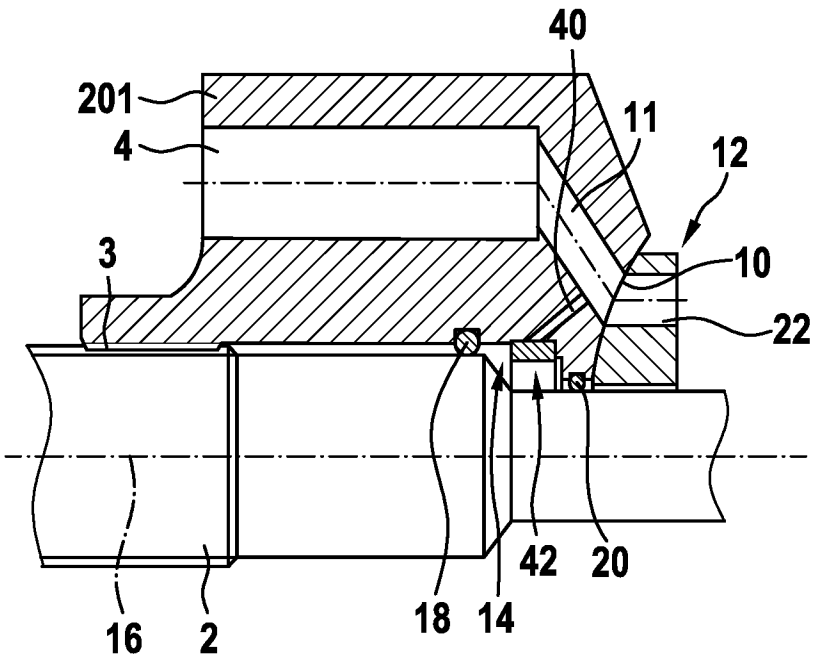
FIG. 9 is a longitudinal section of a portion of the axial piston machine according to the disclosure according to a fifth embodiment.

FIG. 9 shows significant components of a fifth embodiment of the axial piston machine according to the disclosure as also configured for the pressure side change. The cylinder drum 201 has for each connection channel 11 a connection branch channel 40 which extends in the direction toward the pressing pressure chamber 14. The corresponding branch channel openings which are formed on the inner periphery of the cylinder drum 201 are together covered by a resilient ring 42 which is tensioned radially outwardly. Consequently, there is formed a non-return valve arrangement which is simple in technical device terms and which ensures that only pressure medium from the cylinders 4 which are acted on with high pressure HD are always connected to the pressing pressure chamber 14 via the connection channels 11 thereof and the connection branch channels 40 thereof in order to supply the pressing pressure chamber 14.

There is disclosed a hydrostatic axial piston machine having a pressing pressure chamber for the cylinder drum which is supplied with pressing pressure from a circular-arc-like elongate hole of a distributor plate or from a plurality of connection channels of the cylinder drum. The pressing pressure chamber is delimited radially outwardly by the cylinder drum and radially inwardly by the drive shaft. The pressing pressure chamber is delimited axially at both sides by seals which are both arranged between the radially inner rotating drive shaft and a radially outer stationary component. The radially outer component may be the cylinder drum or, in the case of the distributor-plate-side seal, also a gap seal between the drive shaft and a bearing bush of the distributor plate. Both seals are arranged at the distributor plate side with respect to a tooth arrangement or a retraction ball.

LIST OF REFERENCE NUMERALS

1; 101; 201 Cylinder drum
2 Drive shaft
3 Tooth arrangement
4 Cylinder
6 Piston
7 Sliding block
8 Swash plate
10 Opening
11 Connection channel
12;112;212;312 Distributor plate
13 Closure plate
14 Pressing pressure chamber
16 Rotation axis
18 Swash-plate-side seal
20; 120 Distributor-plate-side seal
22 Circular-arc-like elongate hole
24 Annular groove
26 Radial groove
28 Axial channel
30 Through-drive
32 Bearing bush
34 Main channel
36 Shuttle valve
38 Non-return valve
40 Connection branch channel
42 Resilient ring
120 Distributor-plate-side gap seal
124 Intermediate space
$D_3$ Root diameter
$D_{18}$ Sealing diameter
$D_{20}$ Sealing diameter
$D_{120}$ Sealing diameter
HD High pressure
ND Low pressure

The invention claimed is:

1. A hydrostatic axial piston machine, comprising:
a plurality of pistons;
a cylinder drum in which the plurality of pistons are guided;
a swash plate to which the plurality of pistons are coupled;
a drive shaft coupled to the cylinder drum in a rotationally secure manner; and
a hydrostatic pressing device that tensions the cylinder drum against a stationary distributor plate, the hydrostatic pressing device having a pressing pressure chamber delimited by the drive shaft and the cylinder drum and which is delimited by a swash-plate-side seal and a distributor-plate-side seal,
wherein both the swash-plate-side seal and the distributor-plate-side seal are directly in abutment with the drive shaft, and the swash-plate-side seal is arranged directly between the drive shaft and the cylinder drum.

2. The axial piston machine according to claim 1, further comprising:
a tooth arrangement formed between the drive shaft and the cylinder drum,
wherein both the swash-plate-side seal and the distributor-plate-side seal are arranged at a distributor plate side of the tooth arrangement.

3. The axial piston machine according to claim 2, wherein both the swash-plate-side seal and the distributor-plate-side seal have a sealing diameter that is smaller than a root diameter of the tooth arrangement.

4. The axial piston machine according to claim 3, wherein the sealing diameter of the distributor-plate-side seal is smaller than the sealing diameter of the swash-plate-side seal.

5. The axial piston machine according to claim 1, wherein the distributor-plate-side seal is arranged directly between the cylinder drum and the drive shaft.

6. The axial piston machine according to claim 1, wherein the distributor-plate-side seal is arranged between the distributor plate and the drive shaft.

7. The axial piston machine according to claim 1, wherein the distributor-plate-side seal is a sealing ring.

8. The axial piston machine according to claim 1, wherein the distributor-plate-side seal is a gap seal on a bearing bush, and the drive shaft forms a through-drive at the distributor plate side.

9. The axial piston machine according to claim 1, further comprising:
a pressure medium connection between a circular-arc-like elongate hole of the distributor plate, which is acted on with high pressure, and the pressing pressure chamber includes a radial groove of the distributor plate, an annular groove of the distributor plate, and at least one axial channel of the cylinder drum that is directly connected to the annular groove.

10. The axial piston machine according to claim 1, further comprising:

a pressure medium connection between a circular-arc-like elongate hole of the distributor plate, which is acted on with high pressure, and the pressing pressure chamber includes a radial groove of the distributor plate, an intermediate space formed between the distributor plate and the drive shaft, and at least one axial channel of the cylinder drum that is directly connected to the intermediate space.

11. The axial piston machine according to claim 1, further comprising:

a housing having a connection plate in which two main channels are defined; and a pressure medium connection between the two main channels and the pressing pressure chamber, the pressure medium connection including a shuttle valve connected at an input side to the two main channels and at an output side to an annular groove of the distributor plate, wherein the annular groove is directly connected to at least one peripheral axial channel of the cylinder drum.

12. The axial piston machine according to claim 1, wherein the cylinder drum includes a plurality of cylinders, the axial piston machine further comprising:

a connection channel between each cylinder and a respective opening arranged at an end face of the cylinder drum; and a pressure medium connection between a plurality or all of the connection channels and the pressing pressure chamber includes a non-return valve arrangement arranged in the cylinder drum.

13. The axial piston machine according to claim 12, wherein the non-return valve arrangement has a plurality of non-return valves, each of which connects a cylinder or connection channel to the pressing pressure chamber.

14. The axial piston machine according to claim 12, wherein:

each connection channel is connected via a connection branch channel and a branch channel opening to the pressing pressure chamber; and the non-return valve arrangement has a resilient ring arranged on the outer periphery of the pressing pressure chamber, the resilient ring configured to abut the branch channel openings and to be raised from the branch channel openings.

* * * * *